US007703735B2

(12) United States Patent
Fryer et al.

(10) Patent No.: US 7,703,735 B2
(45) Date of Patent: Apr. 27, 2010

(54) HANGER SYSTEM

(76) Inventors: Kevan Fryer, 16 Holcombe Drive, Paraparaumu (NZ); James Houston, P.O. Box 85, Paris, TN (US) 38242-0085

( * ) Notice: Subject to any disclaimer, the term of this patent is extended or adjusted under 35 U.S.C. 154(b) by 825 days.

(21) Appl. No.: 11/412,805

(22) Filed: Apr. 28, 2006

(65) Prior Publication Data

US 2007/0251961 A1 Nov. 1, 2007

(51) Int. Cl.
*A47F 5/00* (2006.01)
*F16B 45/00* (2006.01)

(52) U.S. Cl. ..... 248/339; 24/372

(58) Field of Classification Search ..... 24/372; 211/118, 119; 248/301, 303, 304, 315, 215, 248/322, 339; 223/85
See application file for complete search history.

(56) References Cited

U.S. PATENT DOCUMENTS 1,747,892 A * 2/1930 Fisher ..... 248/317
4,372,450 A * 2/1983 Licari et al. ..... 211/106.01
4,957,259 A * 9/1990 Wolf, Jr. ..... 248/304
5,221,012 A * 6/1993 Licari ..... 211/105
5,553,823 A * 9/1996 Protz, Jr. ..... 248/304
6,299,118 B1 * 10/2001 Farrell ..... 248/327
6,533,132 B1 * 3/2003 Weisenburger ..... 211/70.8
6,575,416 B1 * 6/2003 Avinger ..... 248/307
6,857,608 B2 * 2/2005 Avinger ..... 248/215
7,407,138 B1 * 8/2008 Gretz ..... 248/58

* cited by examiner

*Primary Examiner*—James R Brittain
(74) *Attorney, Agent, or Firm*—Rosenberg, Klein & Lee

(57) ABSTRACT

A hanger system includes a first part and a second part, which is connected to the first part in different directions. The first part has a first body and a round first hanger and a first housing connected to the first body. The first housing has a first polygonal tapered recess. The second part has a second body with a round second hook, a polygonal tapered end piece, which can be inserted into the first polygonal tapered recess in a desired direction so as to meet different needs in practical use.

11 Claims, 13 Drawing Sheets

(A)

(B)

(C)

(D)

(E)

HANGER SYSTEM

FIELD OF THE INVENTION

This invention relates to a hanger system and more particularly, to a multiple purpose hanger system of interconnecting hooks aligned in different directions.

BACKGROUND OF THE INVENTION

A conventional hanger 30 is shown in FIG. 12 and generally includes an S-shaped body with two hooks 31, 32 on each end thereof so that one hook 31 can hang from a protrusion on a wall, or over a rod, and the other hook 32 can be used to hang objects, for example clothes, belts, ties, robes, caps, hats, bags etc. However, it is noted that both of the hooks 31, 32 are located on the same plane and when the hook 31 hangs from the protrusion on a wall, the other hook 32 will be parallel to the wall limiting the space between hook and wall. This is not convenient for the users to hang items on the hook 32. As shown in FIG. 13, another conventional hanger 40 includes two hooks 41, 42 on each end thereof and the two hooks 41, 42 are oriented in different directions so as to improve the drawback of the conventional hanger 30 in FIG. 12. Yet another hanger 50 is disclosed in FIG. 14 and the two hooks 51, 52 are screw thread connected in the middle of the two hooks thereof and the two hooks 51, 52 are oriented in different directions. These hangers 30, 40 have only one hook each to hang an object, which does not satisfy the market. Besides, if two hangers are hung from each other to obtain a longer hanger, only one hook can be used to hang objects and the lower hanger does not position well.

This invention intends to provide a hanger system that includes a first part having a round hanger with a square tapered housing open with a slot on one side thereof at the base of the hanger, and a second part having a round hook with a square tapered end piece which is universally engaged with the open tapered housing of the first part. Another square tapered housing adjacent to the hook is formed on a side of the second part so as to be universally connected with another second part.

SUMMARY OF THE INVENTION

This invention relates to a hanger system that comprises a first part having a first body, a round first hanger connected at the top of the first body and a first tapered housing connected to a side at the base of the first body. The first housing has a first polygonal tapered recess with an opening on one side. A second part has a second body, a round second hook is connected at the base of the second body, a polygonal tapered end piece is connected to the top of the second body and a second tapered housing is connected to a side of the second body adjacent to the round second hook. The polygonal tapered end piece is universally engaged with the first polygonal tapered recess of the first housing of the first part.

The primary object of the present invention is to provide a hanger assembly wherein the first part and the second part can be connected with each other at different positions such that the positions of the round hooks can be oriented as desired.

The present invention will become more obvious from the following description when combined with the accompanying drawings, which show, for purposes of illustration only, a preferred embodiment in accordance with the present invention.

BRIEF DESCRIPTION OF THE DRAWINGS

FIG. 3-1 shows a top view of the second part of the present invention;

DETAILED DESCRIPTION OF THE PREFERRED EMBODIMENT

Figure 1:
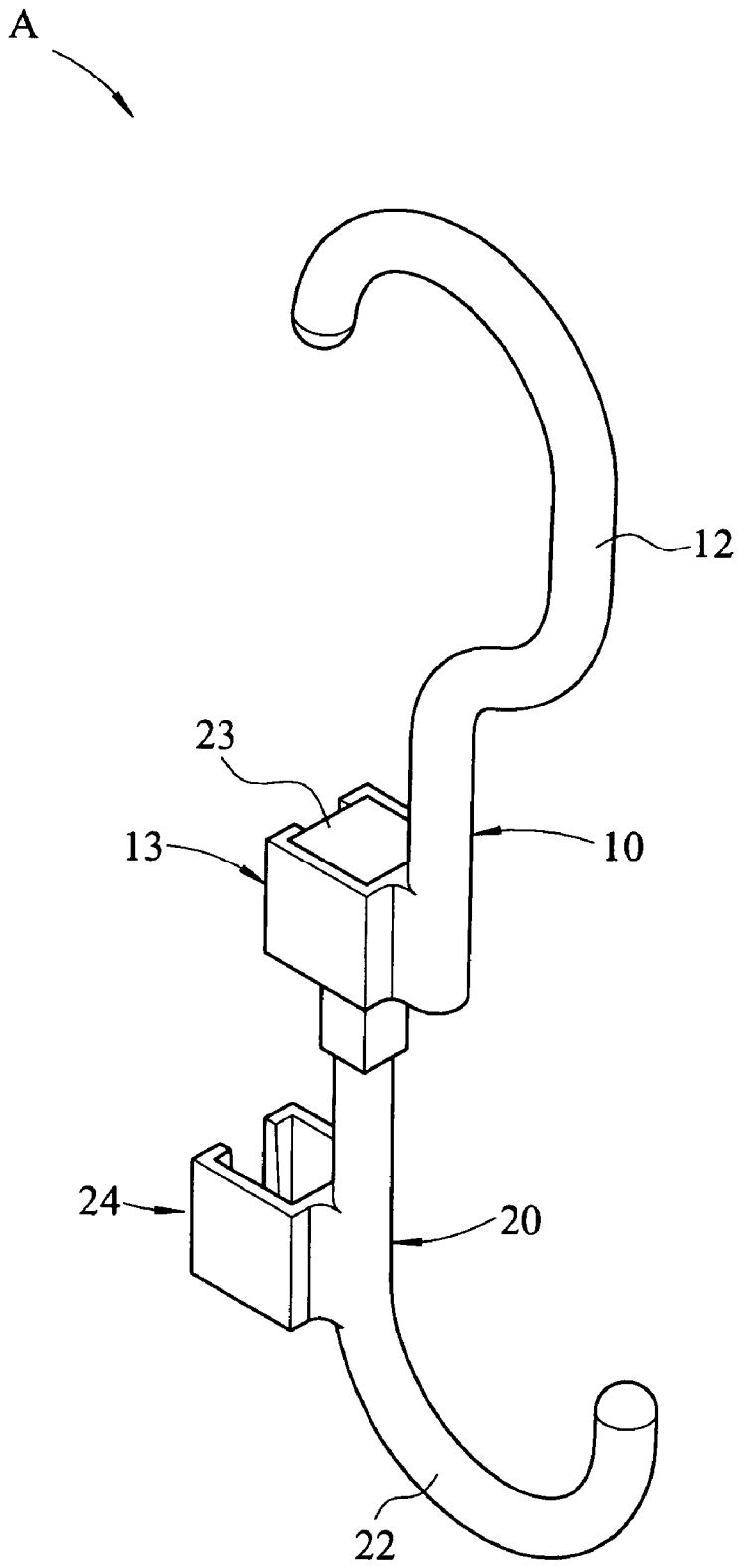
FIG. 1 is a perspective view demonstrating the engagement of the first part to the second part.
Figure 2:
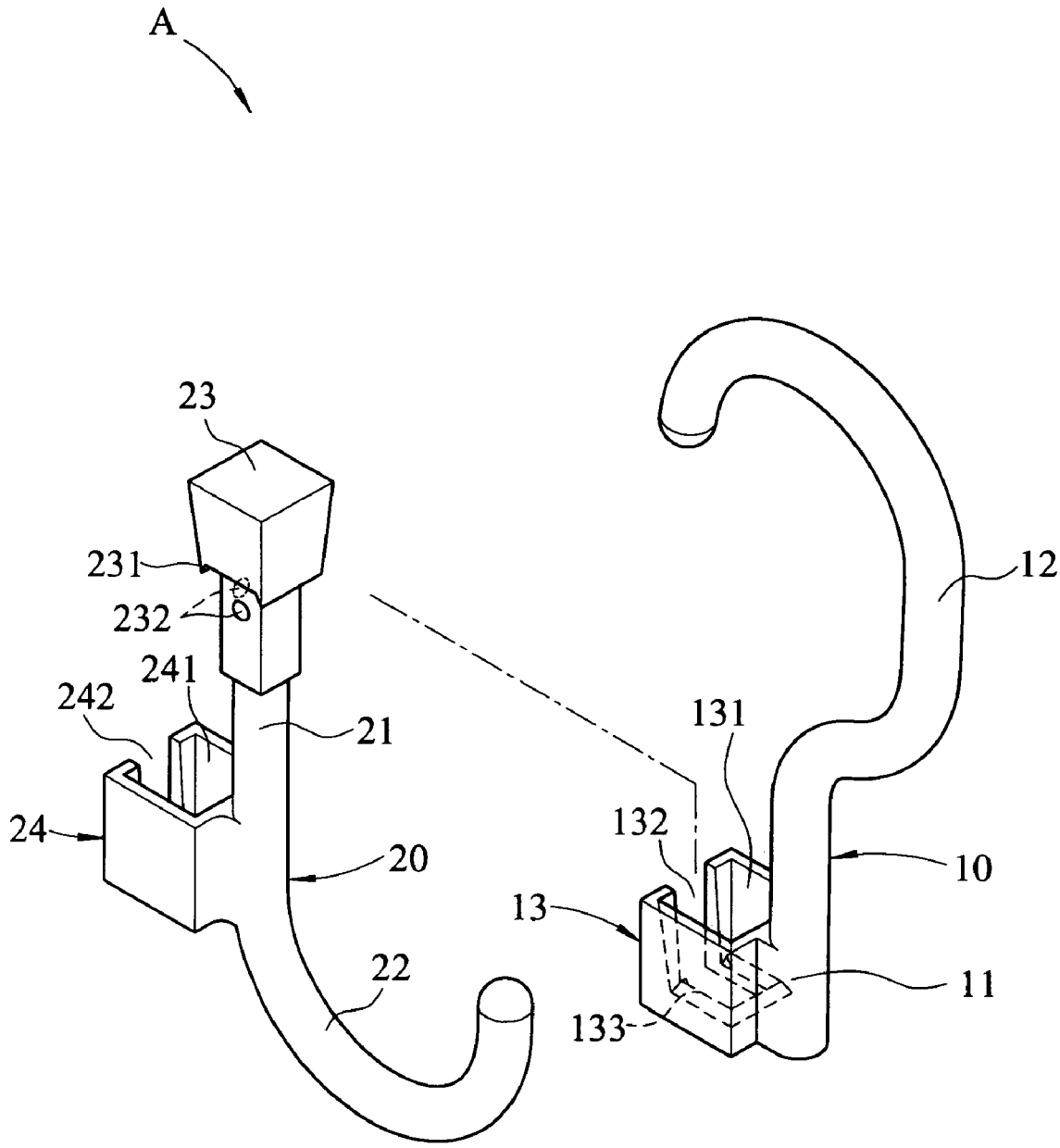
FIG. 2 is an exploded view to show the first part and the second part of the present invention.
Figure 3:
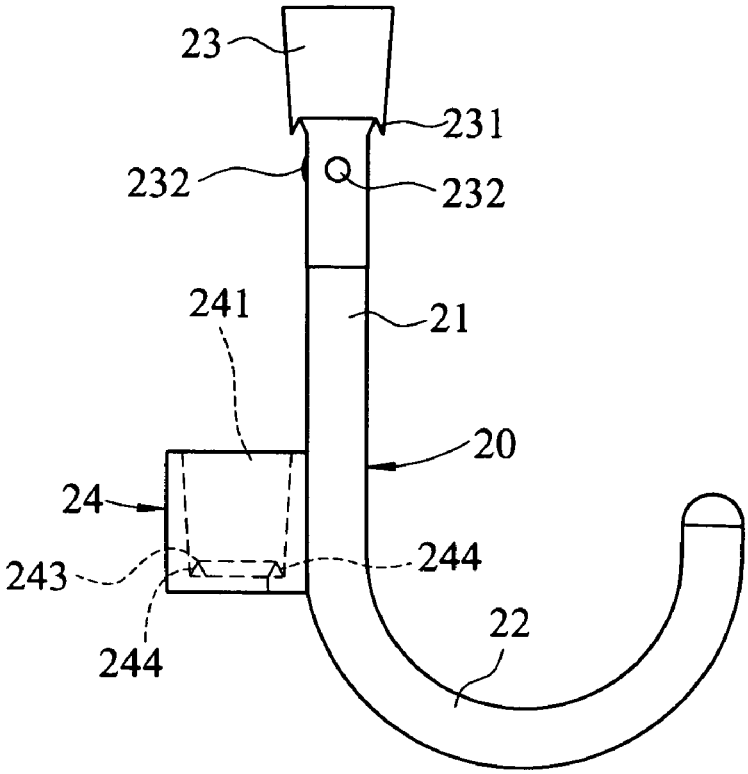
FIG. 3 shows a side view of the second part of the present invention.
Figures 1, 3:
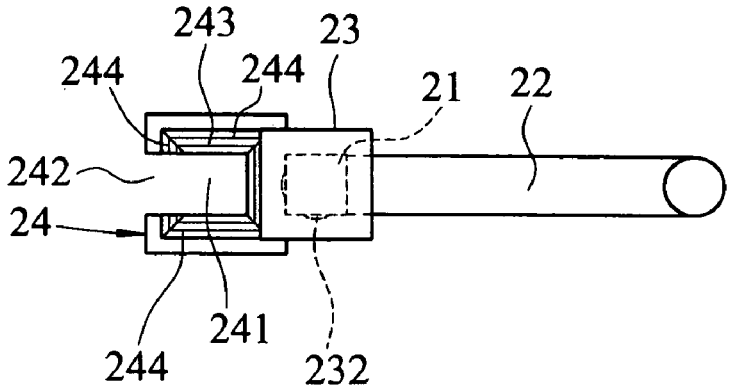
Figure 4:
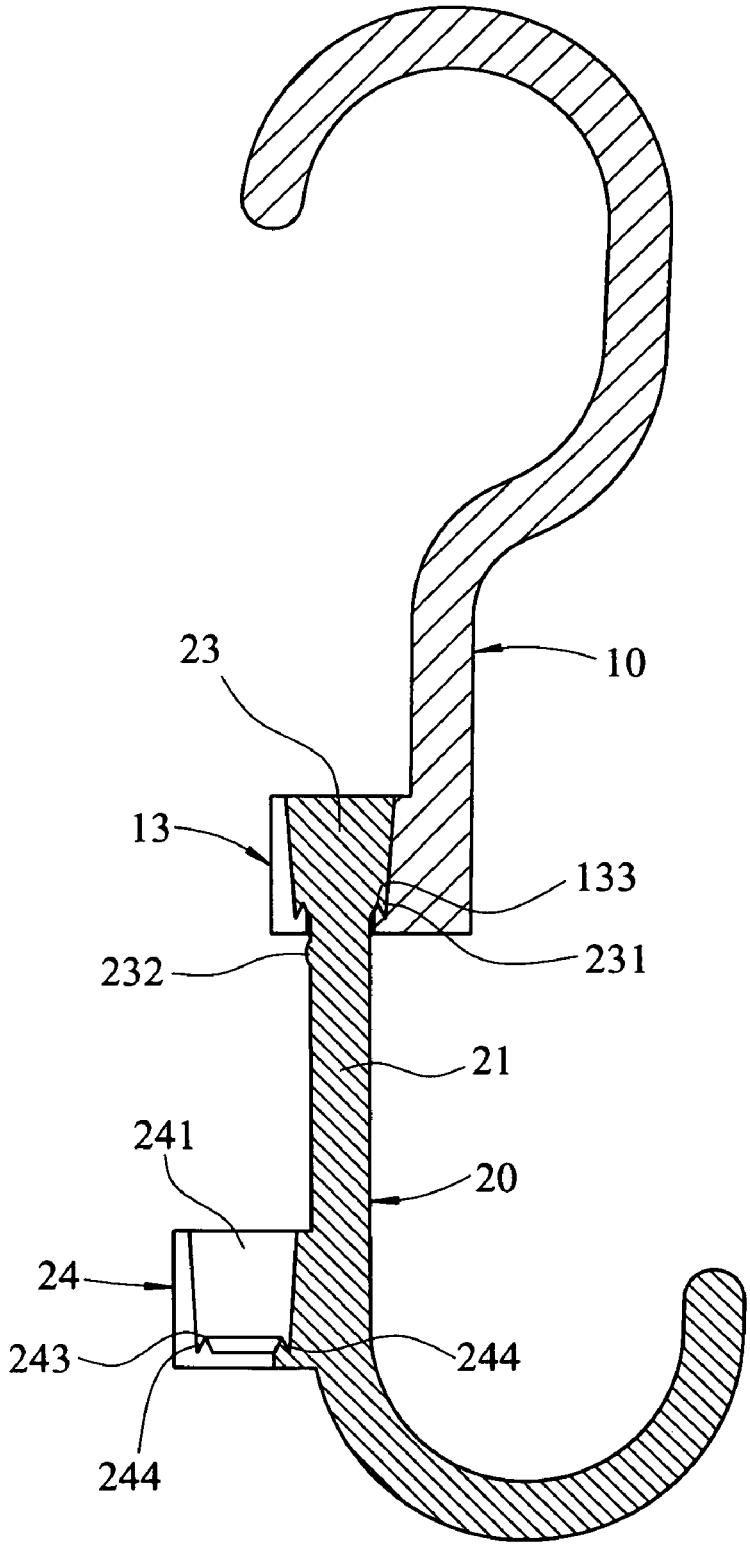
FIG. 4 is a cross sectional view of the combination of the first part and the second part of the present invention.
Figure 5:
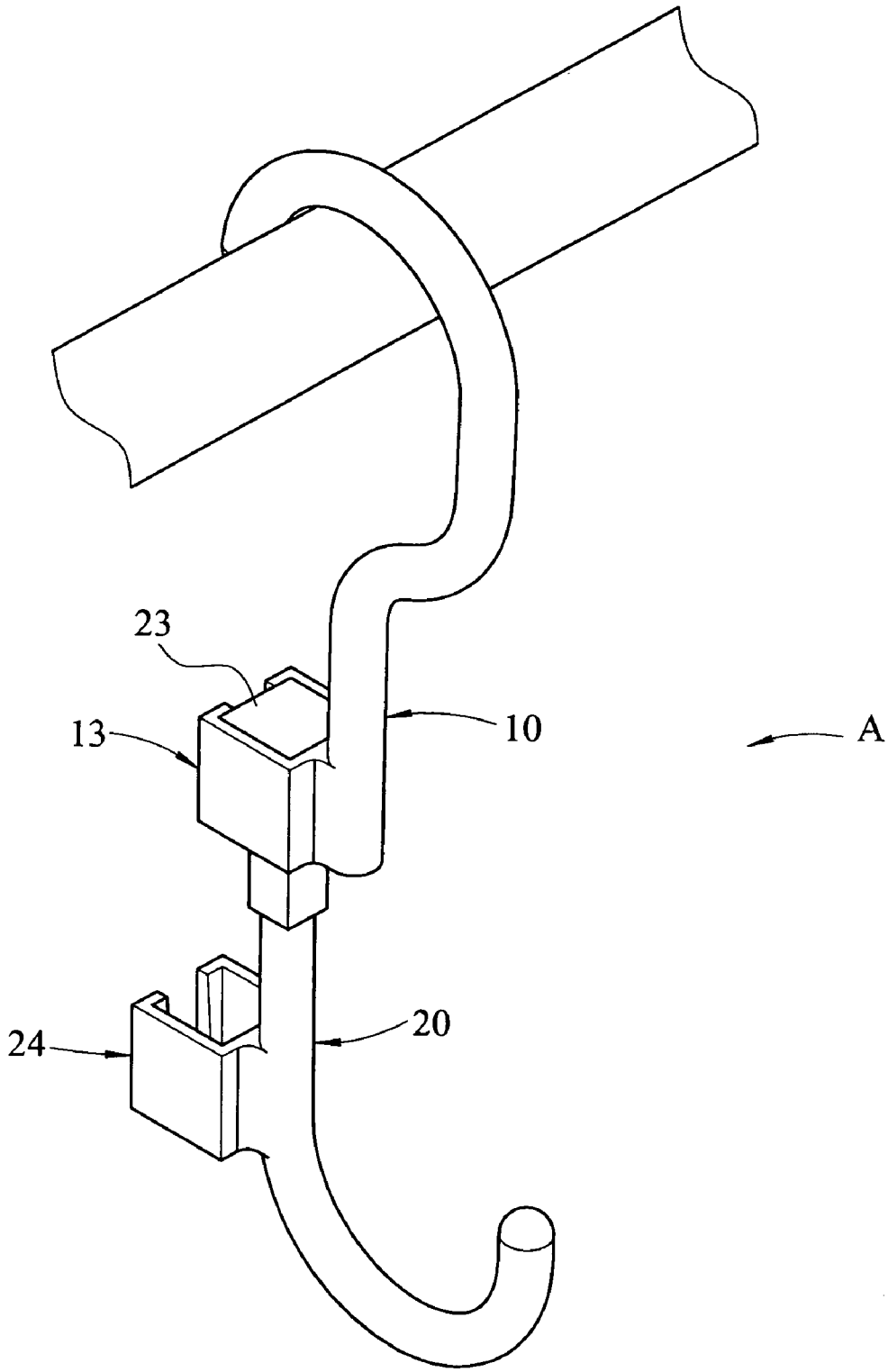
FIG. 5 shows the first part hung from a rod with the second part connected to the first part.

Referring to FIGS. 1 to 5, the hanger system "A" of the present invention comprises a first part 10 and a second part 20. The first part 10 has a first body 11 with a round first hanger 12 connected to an end of the first body 11 and a first housing 13 connected at the side of the first body 11. The first housing 13 has a first polygonal tapered recess 131 shown as a square tapered recess in this embodiment. The first housing 13 includes a front wall, a rear wall connected with the first body 11, two side walls connected between the front and rear walls, and a base, wherein a slot 132 is defined through the front wall and the base. The first housing 13 includes a flange 133 extending from an inner end thereof and four grooves are defined between the flange 133 and the walls of the first housing 13.

Figure 6:
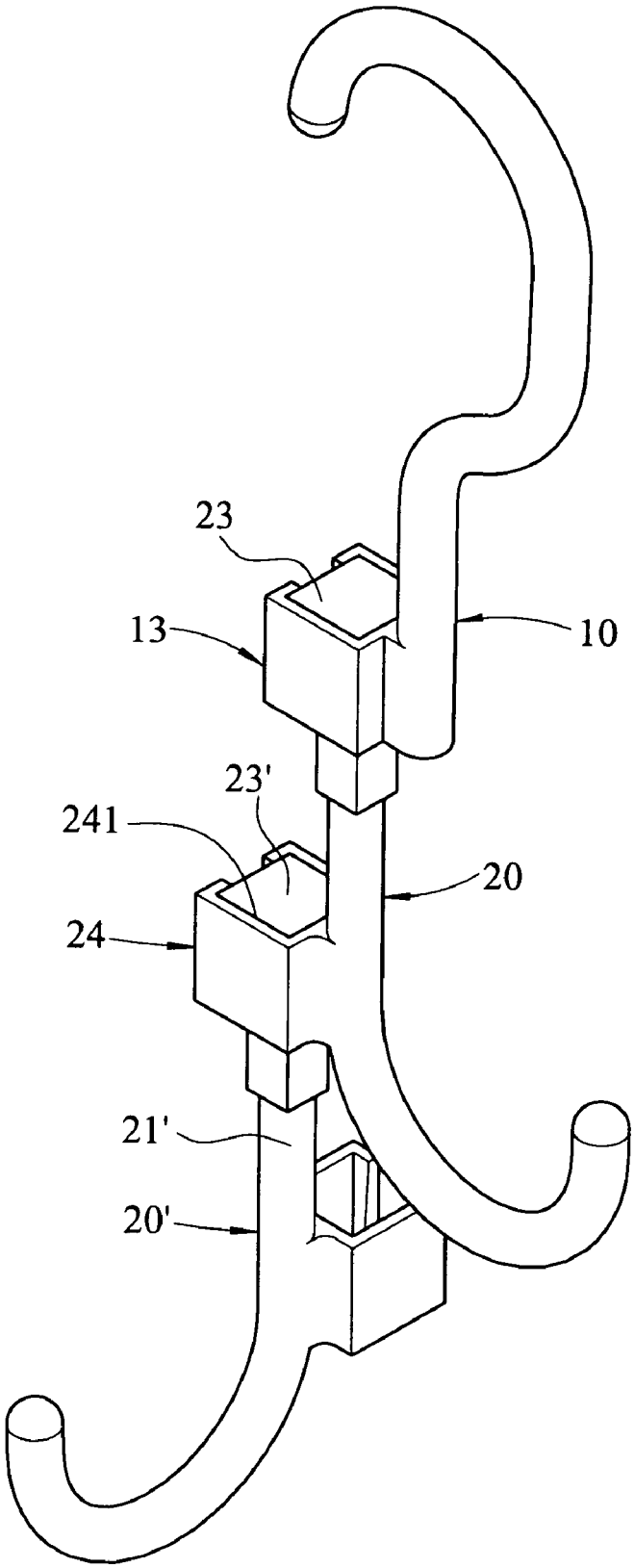
FIG. 6 shows that another second part is connected in a different direction to a second part, which in turn is connected to the first part.
Figure 7:
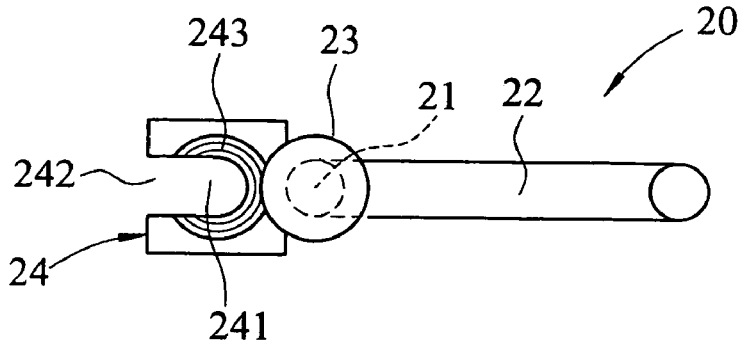
FIG. 7A shows a top view of a first embodiment of the second part.
FIG. 7B shows a top view of a second embodiment of the second part.
FIG. 7C shows a top view of a third embodiment of the second part.
FIG. 7D shows a top view of a fourth embodiment of the second part.
FIG. 7E shows a top view of a fifth embodiment of the second part.
Figure 7:
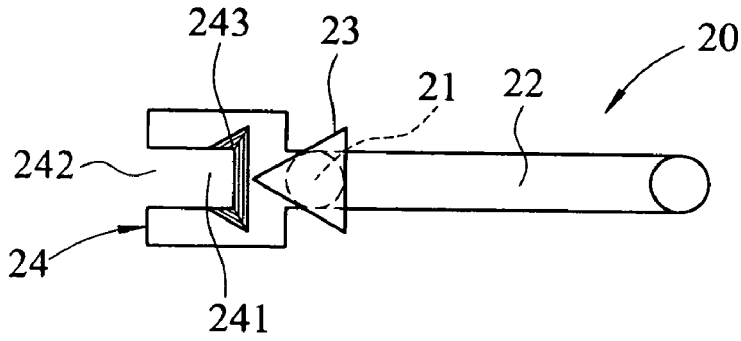
Figure 7:
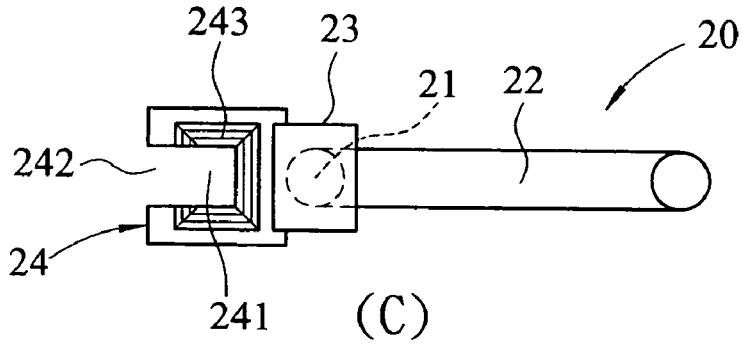
Figure 7:
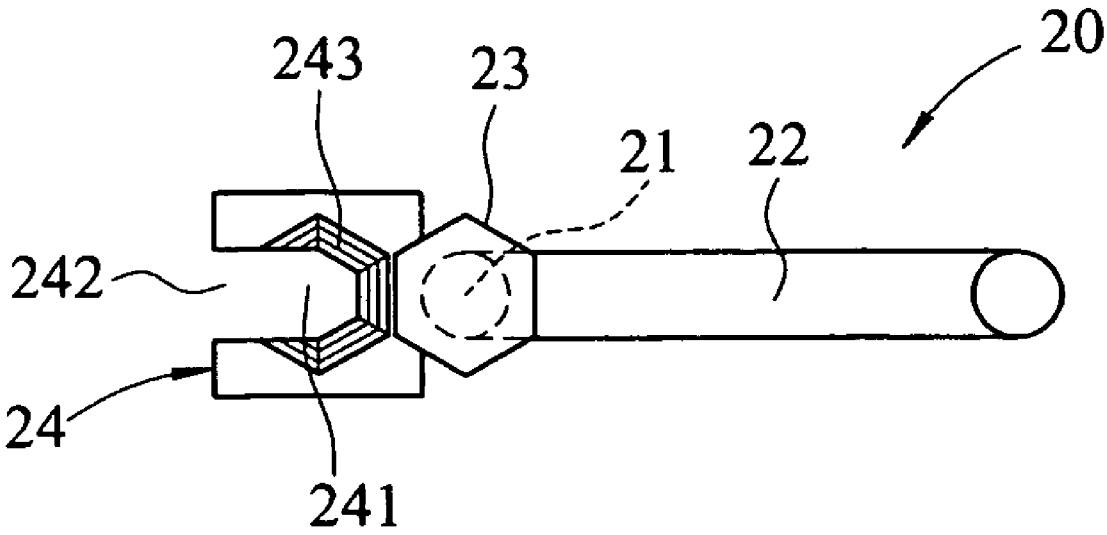
Figure 7:
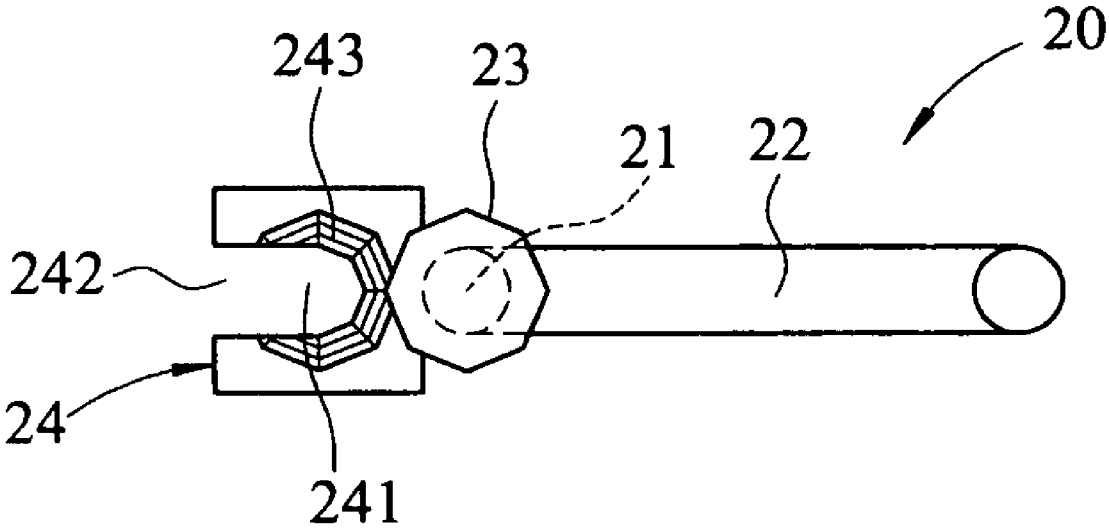

The second part 20 has a second body 21 with a round second hook 22 connected to an end of the second body 21 and a polygonal tapered end piece 23 connected to the other end of the second body 21. A rectangular section is connected between the second body 21 and the polygonal tapered end piece 23. Two bosses 232 extend from two adjacent sides of the rectangular section. The polygonal tapered end piece 23 is shaped to interface with the first polygonal tapered recess 131 of the first housing 13 of the first part 10. The polygonal tapered end piece 23 can be located in the first polygonal tapered recess 131 and includes two angled protrusions 231, which engage with any two of the four grooves of the first polygonal tapered recess 131. The bosses 232 prevent disengagement between the polygonal tapered end piece 23 and the first polygonal tapered recess 131 of the first housing 13. By the engagement of the polygonal tapered end piece 23 and the first polygonal tapered recess 131, the first part 10 and the second part 20 are interlocked with each other. Another second part 20' can be connected with the second part 20 at the position shown in FIG. 6 so that the round second hooks 22 of the two second parts 20, 20' are positioned in different directions relative to the first part 10.

Furthermore, the second body 21 has a second housing 24 connected to a side thereof and the second housing 24 has a second polygonal tapered recess 241 shown as a square tapered recess in this embodiment. The second housing 24 is identical to the first housing 13 and includes a slot 242 defined through a wall thereof and the slot 242 opens to the side and base of the second housing 24. A flange 243 extends from an inner end thereof and four grooves are defined between the flange 243 and the walls of the second housing 24. Therefore, another second part can be connected to the second housing 24 to form a long hanger with multiple round hooks.

FIGS. 7A to 7E show that the shape of the polygonal tapered end piece 23 can be a circular design, a triangular design, a rectangular design, a hexagonal design or an octagonal design. The shapes of the polygonal tapered recesses 131, 241 are also made according to the corresponding polygonal tapered end piece 23.

Figure 8:
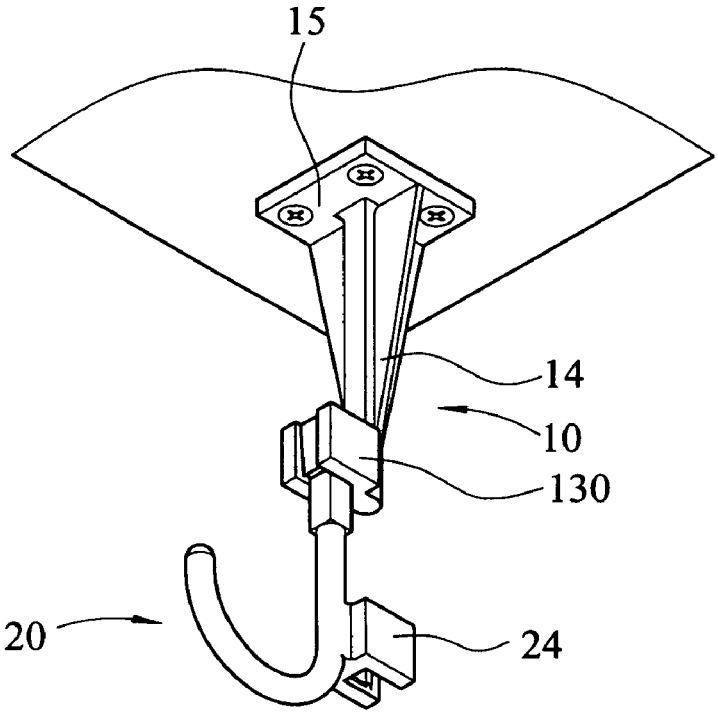
FIG. 8 shows a second part connected with a bracket mounted horizontally to a ceiling.
Figure 9:
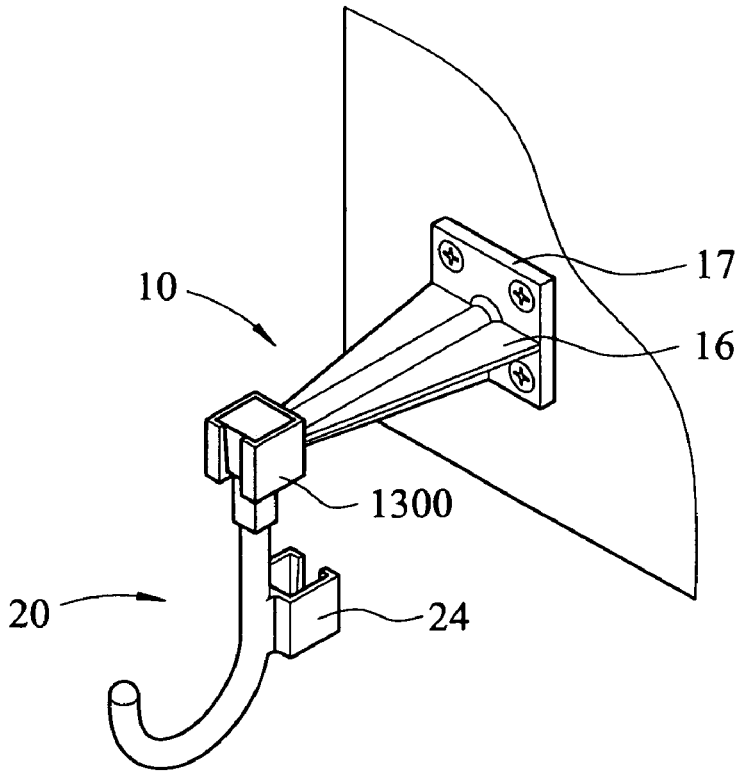
FIG. 9 shows a second part connected with a bracket mounted vertically to a wall.

Referring to FIG. 8, the second part 20 of the present invention can be connected to a first bracket 14 which has a mounting flange 15 on an end thereof and a third tapered housing 130 is connected to the other end of the first bracket 14. The mounting flange 15 is fixed horizontally to a ceiling and the third housing 130 includes a third polygonal tapered recess. The polygonal tapered end piece 23 of the second part 20 can be engaged with the third polygonal tapered recess of the third housing 130. The second part 20 of the present invention can be connected to a second bracket 16 as shown in FIG. 9, wherein the second bracket 16 has a mounting flange 17 on an end thereof and a fourth housing 1300 is connected to the other end of the second bracket 16. The mounting flange 17 is fixed vertically to a wall and the fourth housing 1300 includes a fourth polygonal tapered recess. The polygonal tapered end piece 23 of the second part 20 can be engaged with the fourth polygonal tapered recess of the third housing 1300.

Figure 10:
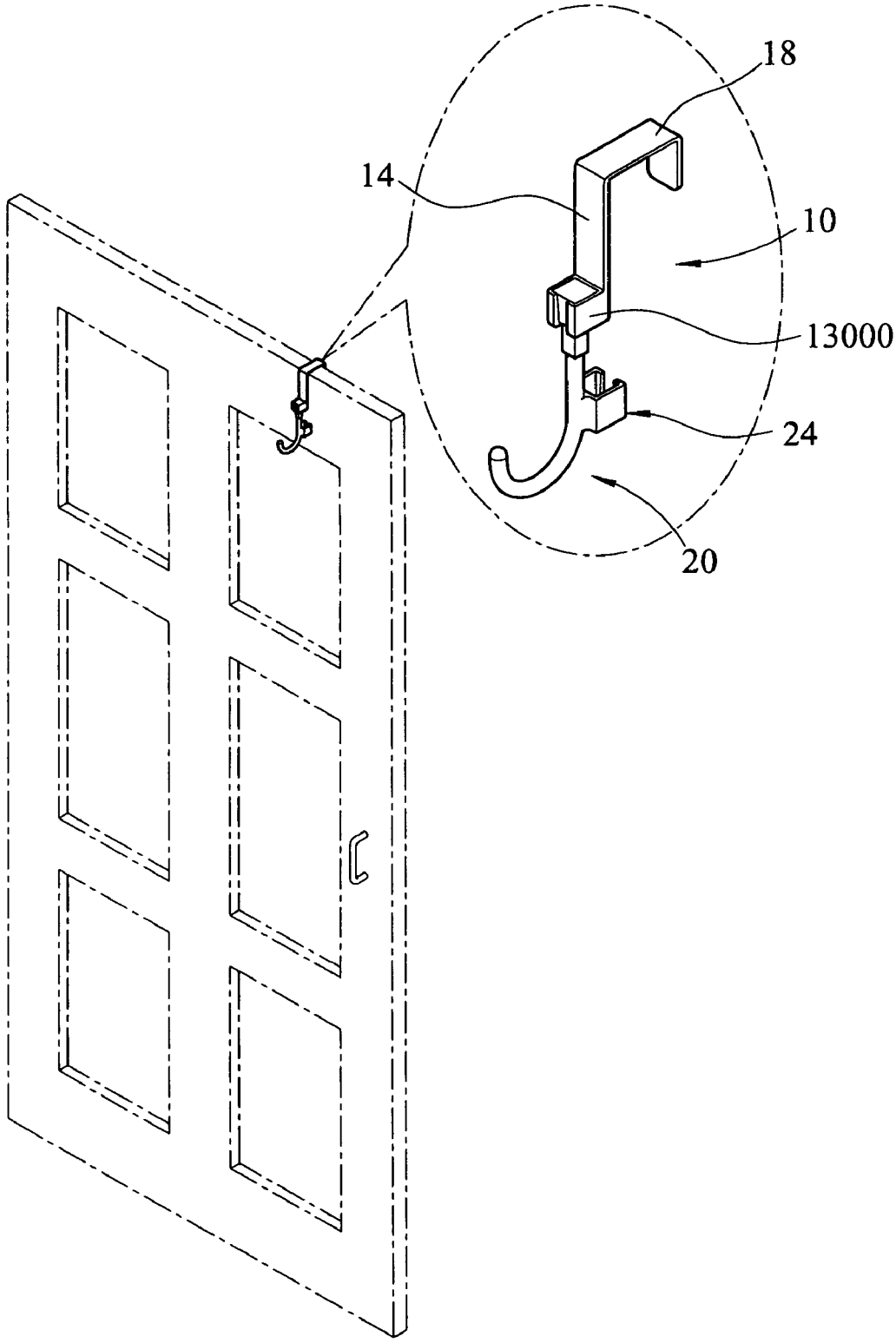
FIG. 10 shows a second part connected to a U shaped bracket mounted over a door.

As shown in FIG. 10, the second part 20 can also be connected to a U shaped bracket which includes a fifth housing 13000 connected to an end thereof and a hook 18 is connected to the other end of the U shaped bracket. The hook (U shaped) 18 is defined as a rectangular flat plate and can be hooked over the top of a door or window.

Figure 11:
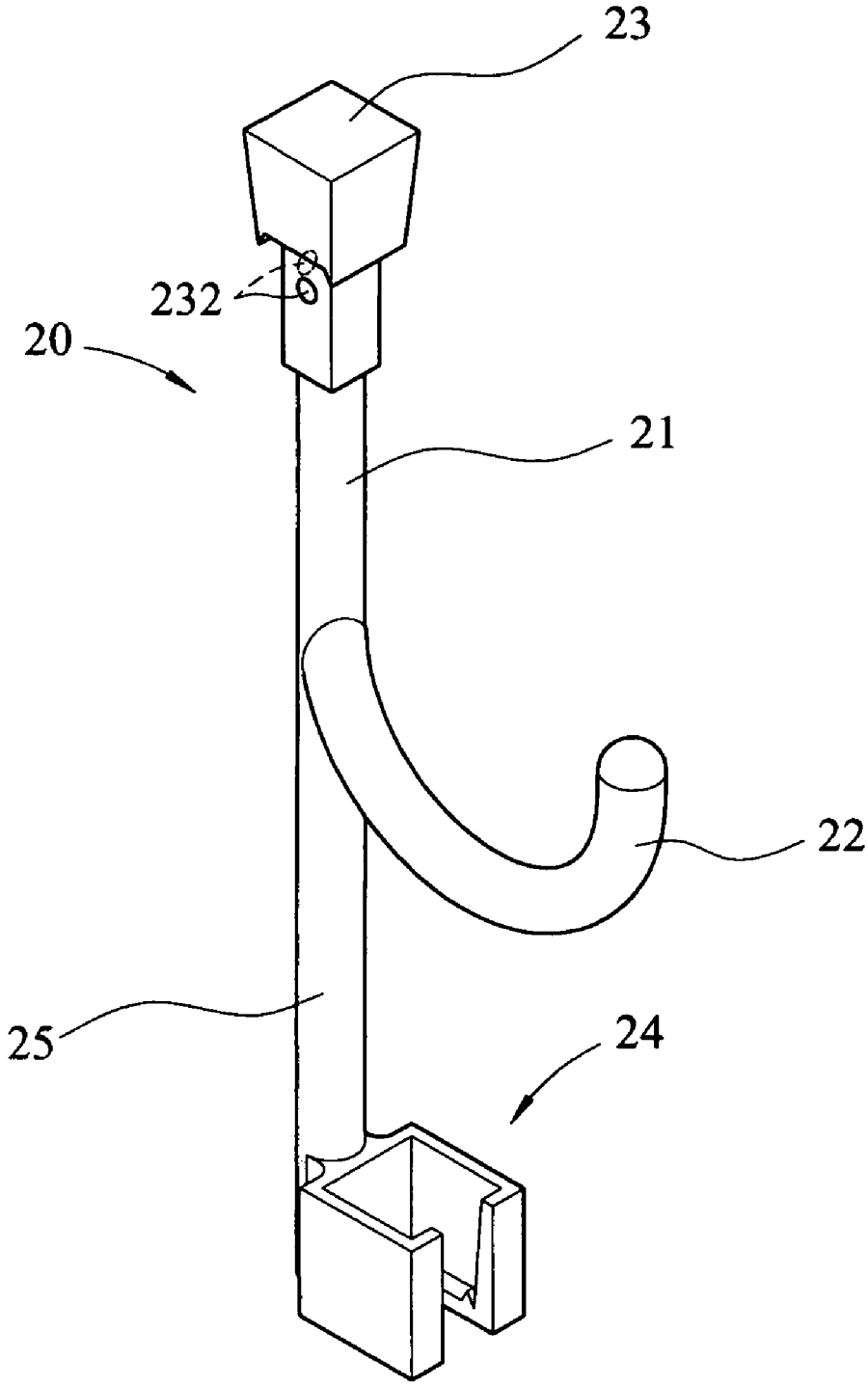
FIG. 11 shows a sixth embodiment of the second part.
Figure 12:
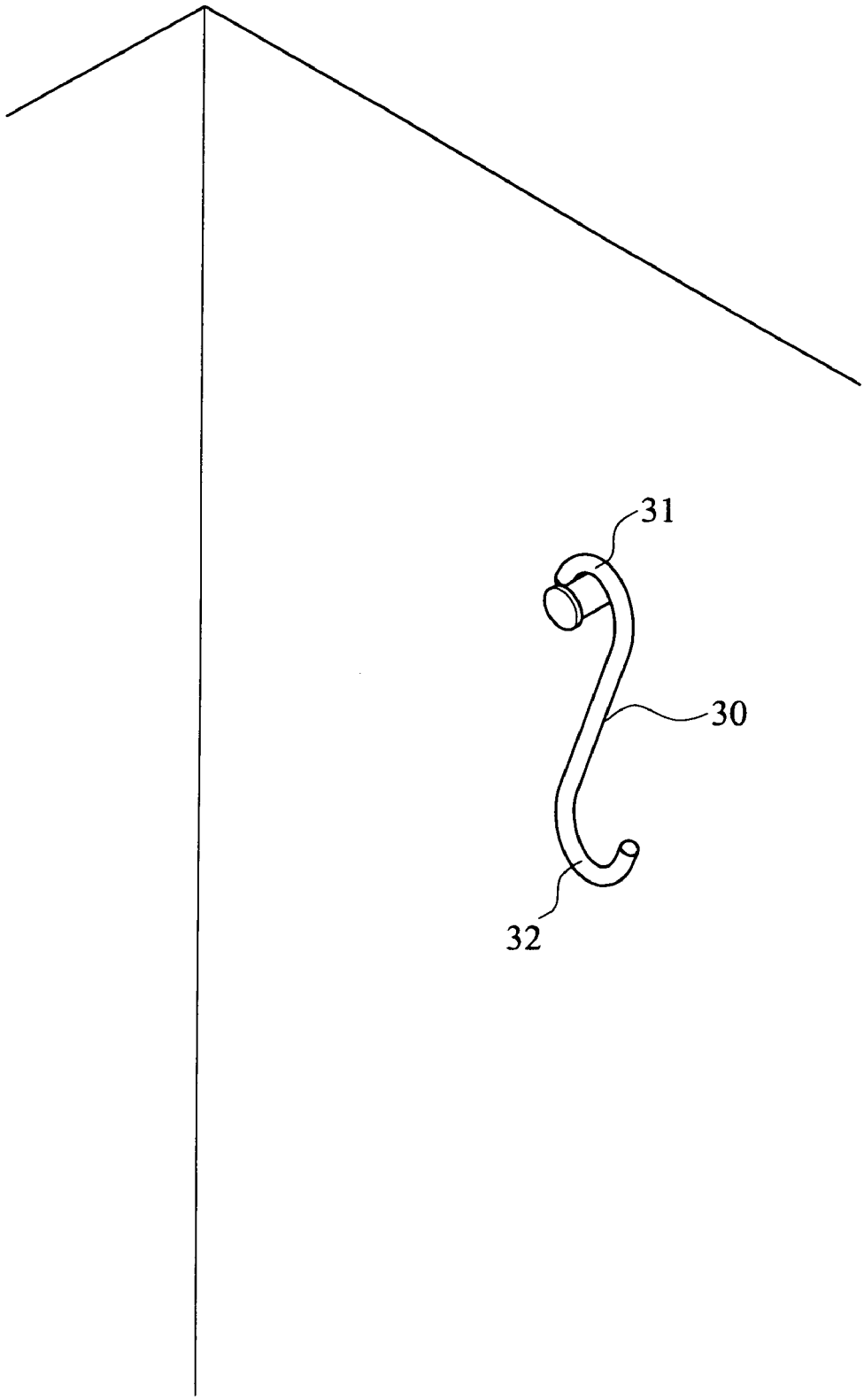
FIG.12 PRIOR ART
FIG. 12 shows a conventional hanger.
Figure 14:
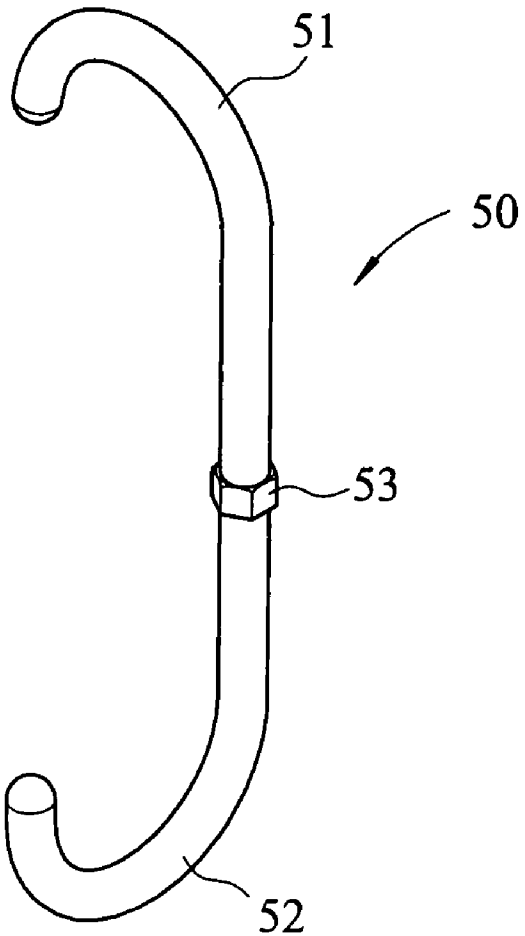
FIG.14 PRIOR ART
FIG. 14 shows yet another conventional hanger.
Figure 13:
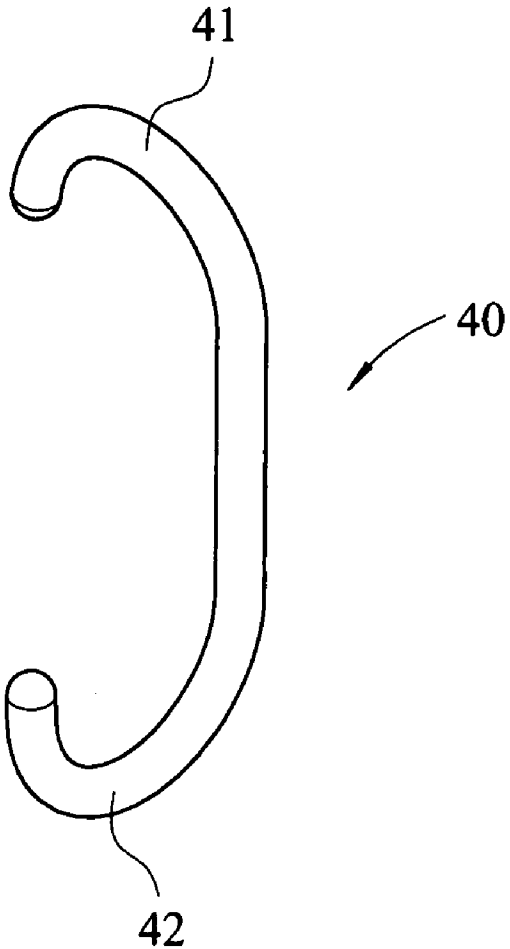
FIG.13 PRIOR ART
FIG. 13 shows another conventional hanger.

FIG. 11 shows that the second part 20 may have an extended body 25 which shares a common axis with the second body 21, the polygonal tapered end piece 23 is connected to a distal end of the second body 21 and the second housing 24 is connected to another distal end of the extended body 25. The round second hook 22 is connected to the second body 21 and located between the polygonal tapered end piece 23 and the second housing 24.

While we have shown and described the embodiment in accordance with the present invention, it should be obvious to those skilled in the art that further embodiments may be made without departing from the scope of the present invention.

What is claimed is:

1. A hanger system comprising: a first part (10) having a first body (11), a round first hanger (12) and a first housing (13) connected to the first body (11), the first housing (13) having a first polygonal tapered recess (131), and a second part (20) having a second body (21), a round second hook (22) and a polygonal tapered end piece (23) connected to the second body (21), the polygonal tapered end piece (23) universally engaged with the first polygonal tapered recess (131) of the first housing (13) of the first part (10);

wherein the first housing (13) includes a flange (133) extending from an inner end thereof and four grooves are defined between the flange (133) and the walls of the first housing (13), the polygonal tapered end piece (23) includes two protrusions (231) which engage with any two of the four grooves.

2. The hanger system as claimed in claim 1, wherein the first housing (13) includes a slot (132) defined through a wall thereof and the slot (132) opens on a side and through a base of the first housing (13).

3. The hanger system as claimed in claim 1, the second body (21) has a second housing (24) connected to a side thereof and the second housing (24) has a second polygonal tapered recess (241).

4. The hanger system as claimed in claim 3, wherein the second housing (24) includes a slot (242) defined through a wall thereof and the slot (242) opens on a side and through a base of the second housing (24).

5. The hanger system as claimed in claim 3, wherein the second housing (24) includes a flange (243) extending from an inner end thereof and four grooves are defined between the flange (243) and the walls of the second housing (24).

6. The hanger system as claimed in claim 3, wherein the round second hook (22) is connected between the polygonal tapered end piece (23) and the second polygonal tapered housing (24).

7. The hanger system as claimed in claim 3, wherein the second housing (24) is connected between the polygonal tapered end piece (23) and the round second hook (22).

8. The hanger system as claimed in claim 1, a rectangular section is connected between the second body (21) and the polygonal tapered end piece (23), two bosses (232) extend from two adjacent sides of the rectangular section.

9. The hanger system as claimed in claim 1 further comprises a first bracket (14) which has a mounting flange (15) on an end thereof and a third housing (130) is connected to the other end of the first bracket (14), the mounting flange (15) is adapted to be fixed horizontally to a ceiling and the third housing (130) includes a third polygonal tapered recess.

10. The hanger system as claimed in claim 1 further comprises a second bracket (16) which has a mounting flange (17) on an end thereof and a fourth housing (1300) is connected to the other end of the second bracket (16), the mounting flange (17) is adapted to be fixed vertically to a wall, the fourth housing (1300) includes a fourth polygonal tapered recess.

11. The hanger system as claimed in claim 1 further comprises a U shaped bracket which includes a fifth housing (13000) connected to an end thereof and a rectangular flat plate (18) is connected to the other end of the U shaped bracket, which forms the hook portion.

* * * * *